US009706841B2

(12) United States Patent
Clements

(10) Patent No.: US 9,706,841 B2
(45) Date of Patent: Jul. 18, 2017

(54) STORAGE UNIT AND ANCHORING SYSTEM THEREFOR

(71) Applicant: Penco Products, Inc., Greenville, NC (US)

(72) Inventor: Calyn Clements, American Fork, UT (US)

(73) Assignee: PENCO PRODUCTS, INC., Greenville, NC (US)

( * ) Notice: Subject to any disclaimer, the term of this patent is extended or adjusted under 35 U.S.C. 154(b) by 0 days.

(21) Appl. No.: 14/963,931

(22) Filed: Dec. 9, 2015

(65) Prior Publication Data

US 2017/0164738 A1 Jun. 15, 2017

(51) Int. Cl.

| | |
|---|---|
| ***A47B 96/00*** | (2006.01) |
| ***A47B 95/00*** | (2006.01) |
| ***A63B 71/00*** | (2006.01) |

(52) U.S. Cl.

CPC ..... *A47B 95/008* (2013.01); *A63B 71/0036* (2013.01)

(58) Field of Classification Search

CPC ... A47B 11/04; A47B 2097/008; A47B 97/00; A47B 96/00

USPC ..... 248/680, 219.4, 505; 312/351.1, 245; 52/506.05, 698

See application file for complete search history.

(56) References Cited

U.S. PATENT DOCUMENTS 1,321,742 A * 11/1919 Hendricks ..... F16B 43/00 224/42.39
2,032,591 A * 3/1936 Pride ..... B61D 45/002 114/75
2,568,592 A * 9/1951 O'Connor ..... A47B 47/03 292/145
3,598,013 A * 8/1971 Broberg ..... F16L 3/14 248/317
4,526,020 A * 7/1985 Fey ..... D06F 29/00 248/188.1
4,669,695 A * 6/1987 Chou ..... A47B 97/00 248/154
4,754,948 A * 7/1988 Casciani ..... A47B 95/00 248/500
5,176,437 A * 1/1993 Remington ..... A47B 91/08 248/500
5,192,123 A 3/1993 Wallin
5,314,101 A * 5/1994 White ..... B60R 9/065 224/401

(Continued)

FOREIGN PATENT DOCUMENTS

WO 2009/027318 * 3/2009

*Primary Examiner* — Janet M Wilkens

(74) *Attorney, Agent, or Firm* — Caesar Rivise, PC

(57) ABSTRACT

A storage unit includes an anchoring system. The storage unit includes a back wall and transversely spaced apart side walls providing peripheral walls of an interior compartment for storing articles. At least one retaining member is attached to an interior surface of the storage unit and the back wall includes at least one passage therethrough. The anchoring system including at least one anchoring strap member having a proximal end configured to be securely attached to a supporting wall or member adjacent the back wall of the storage unit. The anchoring strap member(s) extend through corresponding passage(s) and each includes a distal end configured for adjustable attachment to a respective retaining member.

11 Claims, 6 Drawing Sheets

(56) References Cited

U.S. PATENT DOCUMENTS

| | | | | |
|---|---|---|---|---|
| 5,495,969 | A * | 3/1996 | Cardenas | B60R 7/14 211/195 |
| 5,620,123 | A * | 4/1997 | Brisbois | B60R 9/065 224/401 |
| 6,220,562 | B1 * | 4/2001 | Konkle | A47B 97/00 24/298 |
| 6,530,475 | B1 * | 3/2003 | Penney | G06F 1/1628 190/110 |
| 7,175,149 | B2 * | 2/2007 | Gallien | A47B 97/00 248/499 |
| 7,438,510 | B1 * | 10/2008 | Ledford | B60P 7/0807 410/106 |
| 7,963,491 | B2 * | 6/2011 | Schouten | E04G 5/00 24/380 |
| 2009/0134296 | A1 * | 5/2009 | Odishoo | A47K 10/185 248/231.91 |
| 2009/0152914 | A1 * | 6/2009 | Salerno | A47D 1/106 297/217.1 |
| 2010/0133401 | A1 | 6/2010 | Joseph | |
| 2010/0326940 | A1 * | 12/2010 | Donohoe | A47B 47/042 211/153 |
| 2011/0314768 | A1 * | 12/2011 | Johnson | B25B 13/065 52/745.21 |
| 2012/0145873 | A1 * | 6/2012 | Wohlford | H04N 5/64 248/505 |
| 2013/0087675 | A1 * | 4/2013 | Miller | A47B 97/00 248/499 |

* cited by examiner

STORAGE UNIT AND ANCHORING SYSTEM THEREFOR

BACKGROUND OF THE INVENTION

Field of Invention

This invention relates generally to a storage unit configured to be anchored to a wall or other supporting structure and to a storage unit including an anchoring system attached therewith.

Background Art

Storage units, such as lockers, are commonly used to store a variety of articles, such as sports equipment, books, etc. These lockers need to be properly mounted and secured to prevent them from tipping over if they are overloaded or improperly loaded. Anchoring systems for preventing the tipping of lockers often are complex and or difficult to assemble. One way to simplify the anchoring system is to provide for its use externally of the locker. For example, it has been suggested to attach one end of an anchoring strap to a wall and then secure the other end to the top of the locker through a hook and loop fastening system, such as a system sold under the trademark Velcro.

In another prior art system a floor anchor is employed to stabilize a low profile cabinet, such as a tool cabinet. Such a floor anchoring system is disclosed in U.S. Pat. No. 5,192,123, issued to Wallin.

The Wallin floor anchor assembly 34 includes a base plate portion 38 bolted to the floor on top of which a cabinet structure including fork lift channels 22, 24 is positioned. A strap 70 has a hook 72 at one end which engages a slot 74 formed through lug 58. The opposite end of the strap is bolted to the underside of the cabinet to prevent the cabinet from sliding off of the floor anchor assembly 34. The rear wall of the floor anchor assembly is bolted to a supporting wall or other supporting structure.

The system disclosed in the Wallin '123 patent is directed to anchoring a lower portion of a cabinet to a floor; a system that is not desirable for relatively tall lockers and other storage units. In addition, the cabinet disclosed in the Wallin '123 patent requires a separate anchor assembly, e.g., assembly 34 through which anchoring straps extend. The requirement for a separate anchor assembly is not desirable. In addition, in the '123 patent structure the free end of the strap 70 is bolted to the underside of the cabinet. This is a more difficult attachment operation than is desired.

U.S. Publication 2010/0133401 discloses a flexible strap utilized to attach various articles to a wall. In an exemplary disclosure the strap is used to mount a decorative fish to a vertical wall structure. The strap disclosed in the '401 publication includes a number of passages 24, 26 and 27, which can be reinforced. (See FIG. 2A). The function of the strap fastener disclosed in the '401 publication is significantly different than the anchoring function provided by the present invention; having absolutely no bearing on a storage unit and cooperating anchoring system of the type constituting the present invention.

BRIEF SUMMARY OF THE INVENTION

A storage unit of this invention employs an anchoring system for preventing the storage unit from tipping over. The storage unit includes a back wall and transversely spaced apart side walls extending forwardly from the back wall, said back wall and side walls providing peripheral walls of an interior compartment for storing articles. At least one retaining member is attached to a surface of the storage unit in the interior compartment, and the back wall includes at least one passage configured for receiving an anchoring strap member therethrough.

The storage unit as described above constitutes an independent feature of this invention and preferably cooperates with at least one anchoring strap member having a proximal end configured to be securely attached to a supporting wall or member adjacent the back wall of the storage unit; the strap member extending through said at least one passage. Each anchoring strap member includes a distal end configured for adjustable attachment to a respective retaining member, e.g., a buckle cam, whereby each anchoring strap member is adjustably secured to a respective retaining member to maintain each anchoring strap member in a taut condition to stabilize the storage unit and preventing it from tipping over.

In the most preferred embodiment of this invention the storage unit includes two transversely spaced-apart passages through the back wall thereof and two retaining members aligned, respectively, with the two passages. Most preferably this embodiment of the storage unit is employed with two anchoring strap members, each passing through a respective passage and distal ends thereof being attachable to respective retaining members for tightening to anchor or stabilize the storage unit against tipping. If desired, more than two passages, anchoring strap members and retaining members can be employed; however effective anchoring of a storage unit, such as locker, has been achieved with a pair of such anchoring straps and corresponding retaining members.

In some embodiments, effective anchoring may be achieved with only a single anchoring strap passing through a single passage in the back wall of a storage unit and attached to a respective retaining member. Such an arrangement is within the broad scope of this invention.

In the most preferred embodiments of this invention the one or more passages are located through the upper half of the back wall, whereby the anchoring strap members passing therethrough and cooperating with respective retaining members will effectively anchor the storage unit in a region substantially above its lower surface.

Most preferably the one or more retaining members is (are) attached to the storage unit in the interior compartment to provide internal anchoring thereof. This eliminates unsightly external anchoring systems, such as those employing straps attached to the outside surface of a storage unit, such as a locker.

Most preferably the one or more retaining members is (are) secured to an interior surface of the storage unit spaced from the back wall thereof and most preferably closer to a front opening into the storage unit than to the back wall. This provides for the most effective stabilization of the storage unit, and is highly desirable in storage units of substantial height, such as school and sports lockers.

In the most preferred embodiment the storage unit, most preferably a locker, includes a horizontal shelf located in the upper half of the interior compartment and extends forward from a rear edge adjacent the back wall of the storage unit to a front edge adjacent a front opening into the interior compartment of the storage unit. Preferably the one or more retaining members are attached to a lower surface of the horizontal shelf at a location closer to the front opening than to the back wall.

In the most preferred embodiment, a front edge of the horizontal shelf includes a downwardly extending flange or lip terminating at a distal edge, and the one or more retaining member(s) include a buckle for receiving the distal end of a respective anchoring strap member and for permitting tightening of that anchoring strap member within the buckle; with the buckles and anchoring strap members tightened therewith being in a substantially linear, taut condition in a location above the distal edge of the flange to essentially obscure the anchoring system from the view of a person either placing items into, or removing items from an interior compartment of the storage unit.

Other objects and advantages of this invention will become apparent by referring to the description of the drawings which follows taken in conjunction with the detailed description of preferred embodiments of the invention.

DESCRIPTION OF BEST MODES OF THE INVENTION

Figure 1:
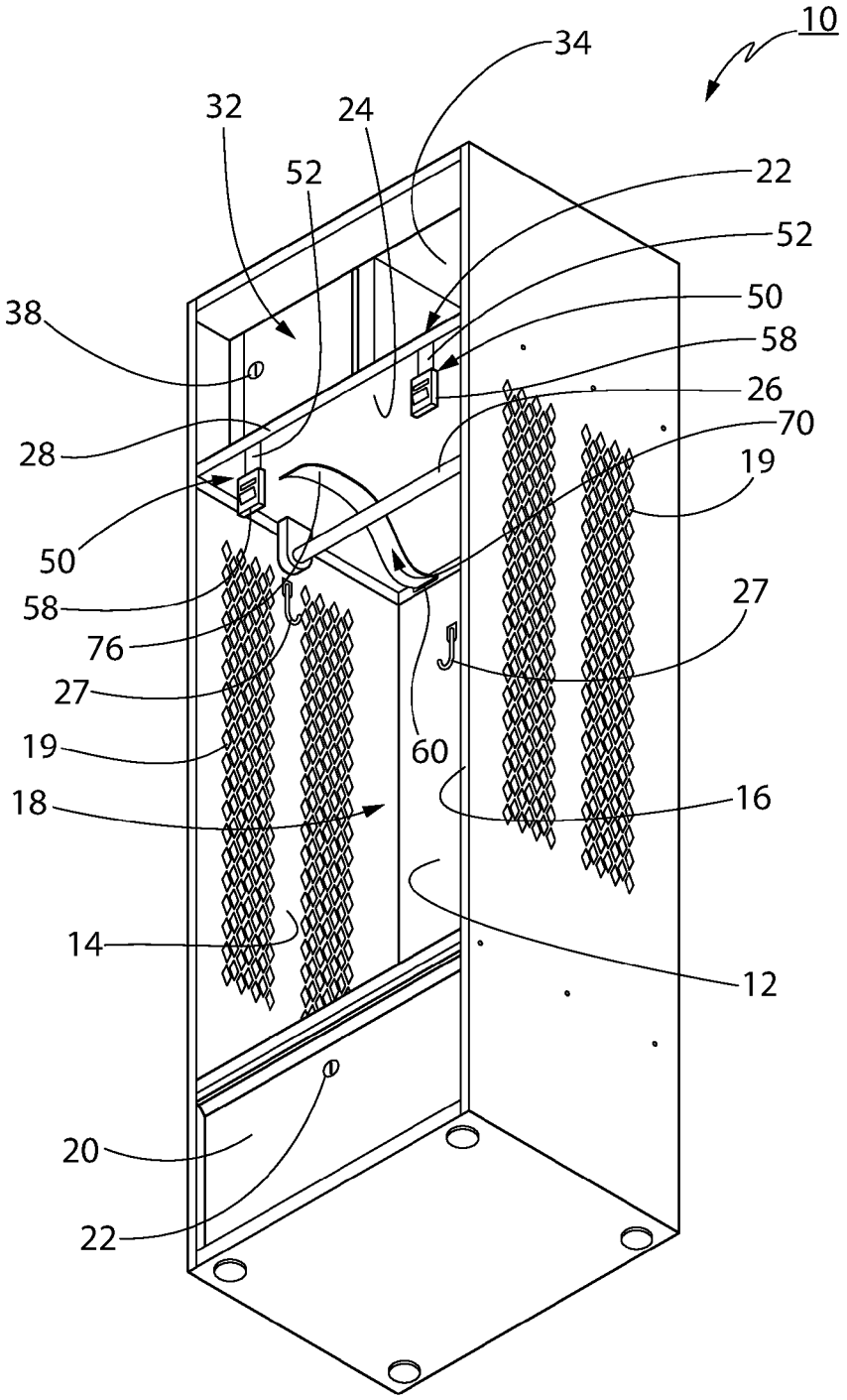
FIG. 1 is an isometric view of a storage unit in accordance with this invention

A storage unit in accordance with this invention is shown generally at 10 in FIG. 1. In the illustrated embodiment, the storage unit is in the form of a sports locker. However, in accordance with the broadest aspects of this invention, the storage unit can include a variety of different configurations, compartments, etc. and can be used/designed to store a variety of different items.

As illustrated in FIG. 1, the storage unit includes a back wall 12 and transversely spaced apart side walls 14, 16 extending forwardly thereof to provide an interior compartment 18 for the storage of articles. If desired the back and/or side walls can be provided with ventilation passages, e.g., passages 19 in the side walls 14 and 16, as is well known in the art. However, the inclusion of ventilation passages is optional and forms no part of the present invention.

In the illustrated embodiment, the interior compartment 18 includes a lower drawer 20 that, if desired, can be provided with a lock, such as a key lock 22, to permit the secure storage of articles therein.

As illustrated, an upper shelf 22 is provided in a region spaced downwardly from the top wall of the locker and most preferably in the upper half of the locker 10; most preferably only a short distance from the top wall of the locker.

Figure 2:
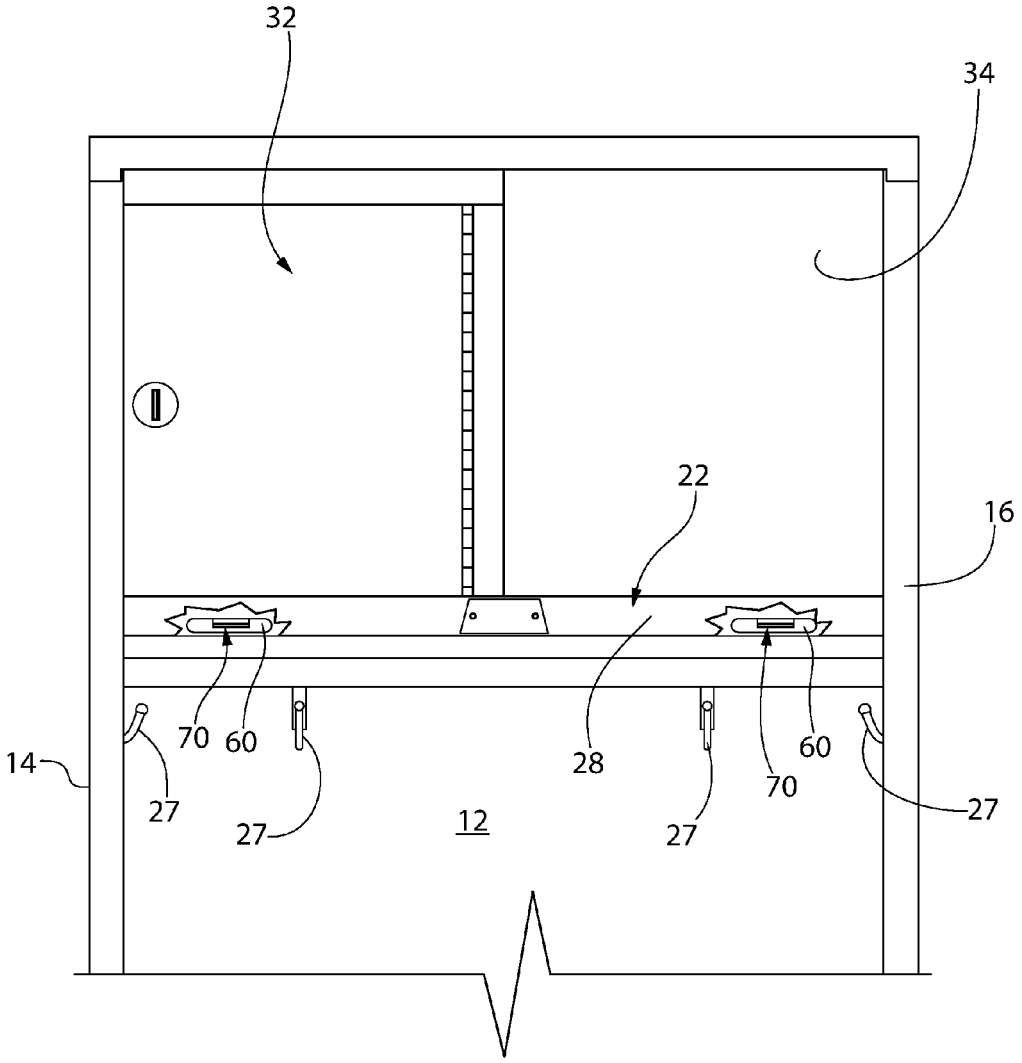
FIG. 2 is a front elevational view of the storage unit in accordance with this invention including sections broken away to show details of construction.

As can be seen in FIG. 1, the shelf 22 includes a lower surface 24 from which a coat rod 26 optionally is supported. The central region of interior compartment 18, in addition to including the transversely extending coat rod 26 also is provided with a number of hooks 27. As shown in FIG. 2 four such hooks are included.

However, in accordance with the broadest aspects of this invention, the interior compartment 18 is not required to include any coat racks, hooks or similar structures. Moreover, in accordance with the broadest aspects of the invention, the lower drawer 20 and upper shelf 22 also can be omitted.

Figure 3A:
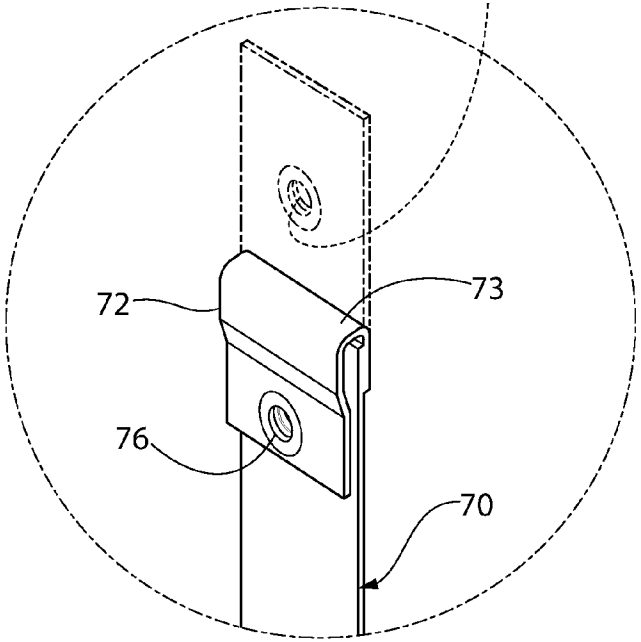
FIG. 3A is an enlarged view of the circled area "3A" in FIG. 3.
Figure 3:
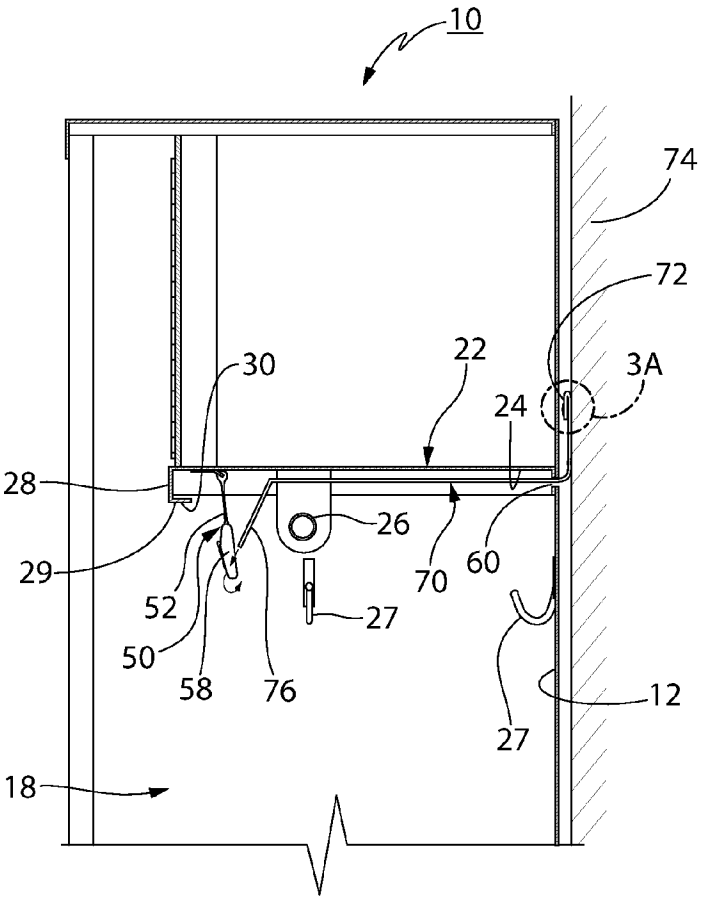
FIG. 3 is a side elevational view of the storage unit in accordance with this invention showing features of an anchoring system of this invention prior to complete attachment thereof.
Figure 4:
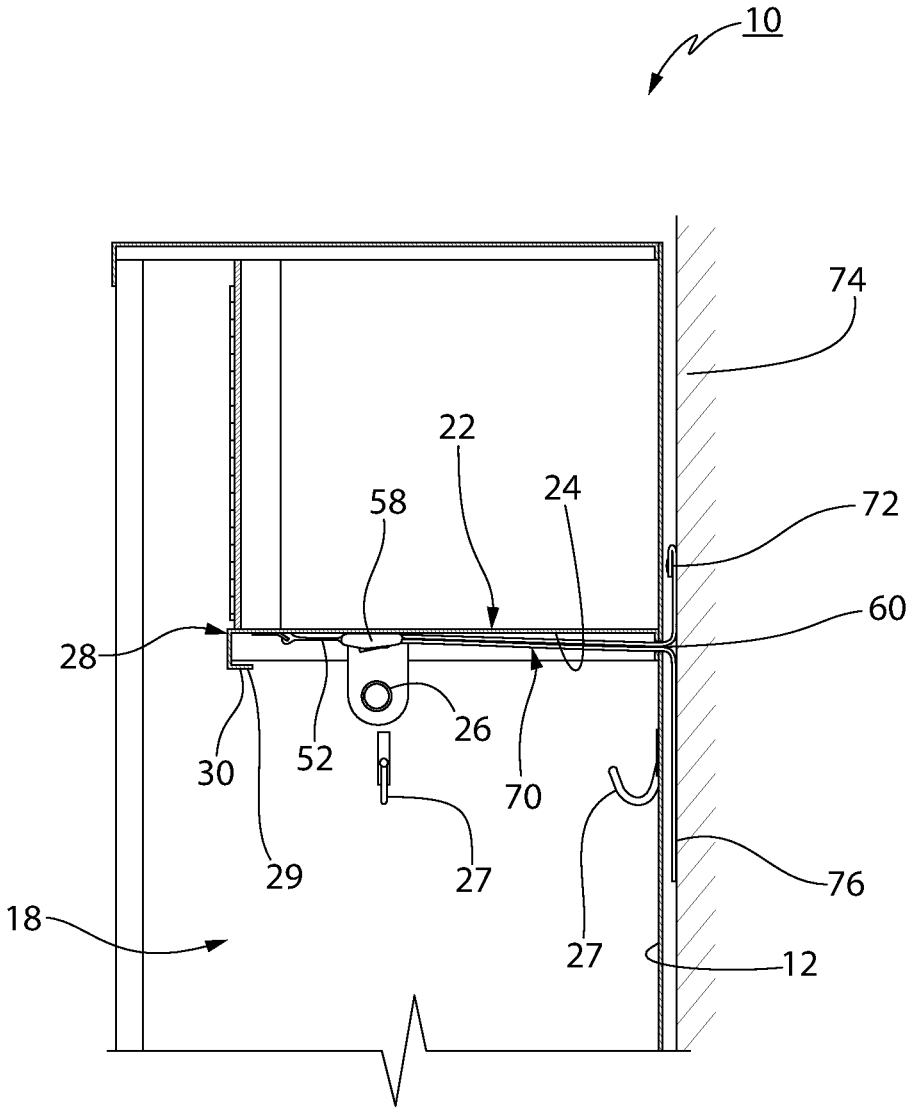
FIG. 4 is a side elevational view of the storage unit similar to FIG. 3 but showing the anchoring system completely attached to prevent undesired tipping of the storage unit.

However, as will be described in detail hereinafter, it is desirable in accordance with the preferred embodiment of this invention to include an upper shelf, such as upper shelf 22 that extends from back wall 12 of the locker and terminates in a front distal end including a downwardly directed flange 28 having an inturned section 29 providing a lower distal surface 30 of the shelf (FIGS. 2-4).

In the illustrated embodiment, the upper section of the interior compartment includes a lock-box 32 and an open-storage section 34. The lock-box section includes a hinged front door 36 for closing the box and this door can include any desired lock, such as a key lock 38. The inclusion of a lock box, or for that manner any closed box, is not a limitation on the present invention.

In the preferred embodiments of the invention, the storage unit 10 includes an upper shelf 22 with the flange 28 extending downwardly therefrom to aid in concealing the anchoring system of this invention, as will be described hereinafter.

However, in the preferred embodiment of this invention, the storage section above shelf 22 does not need to include a lock-box section 32 and an open storage section 34. Moreover, there is no requirement that a coat rod 26 or other supporting hooks, e.g. 27, be included in the interior compartment. Moreover, there is no requirement that a separate, lower drawer 20 be provided in the interior compartment 18.

However, in the most preferred embodiment of this invention upper shelf 22 is provided and most preferably the distal end of the upper shelf has a flange 28 terminating in an inturned section 29 adjacent to the distal end of the flange to aid in concealing the anchoring system of this invention, when the anchoring system is in an operative, taut condition for stabilizing the storage unit 10 as is shown in FIG. 4.

Referring to FIGS. 1 and 2, a pair of retaining assemblies 50 extends downwardly from the lower surface 24 of the upper shelf 22 prior to being engaged with anchoring straps 70 to anchor the storage unit. Each of the retaining assemblies 50 includes a supporting strap 52 attached to the lower surface 24 of the upper shelf 22 in the same manner. Therefore, the arrangement for attaching only one of the supporting straps 52 will be described in detail, and is illustrated in FIG. 5.

Figure 5:
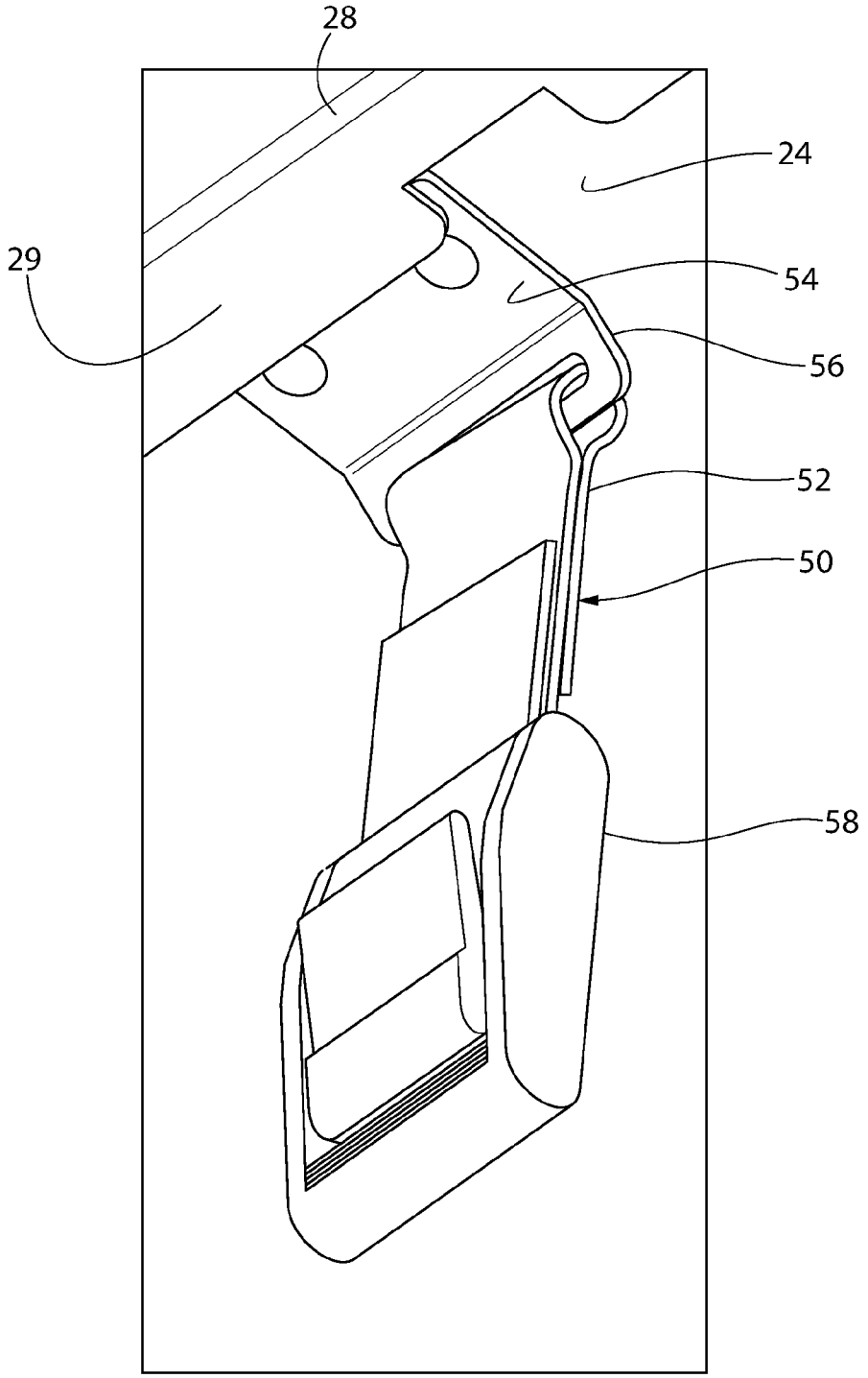
FIG. 5 is a fragmentary isometric view showing a preferred arrangement for connecting to the underside of a storage shelf of the storage unit a retaining member employed as part of an anchoring system.
Figure 6A:
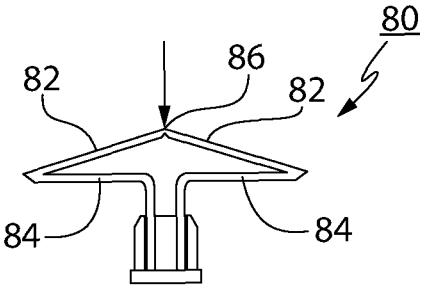
FIGS. 6A-6E sequential steps of securing an anchoring strap to wall in a region that is not aligned with a stud or other solid member for receiving a mounting screw therein.
Figure 6B:
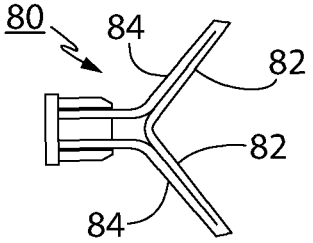
Figure 6C:
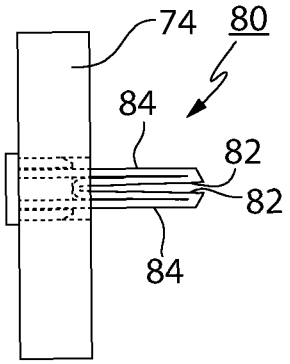
Figure 6D:
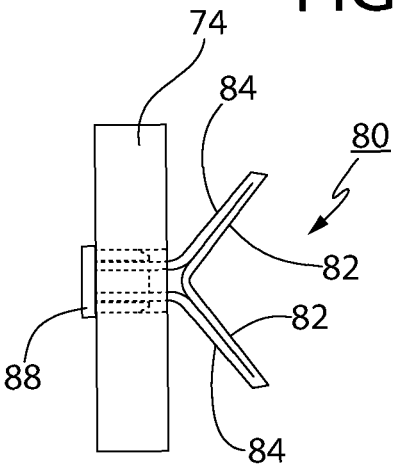
Figure 6E:
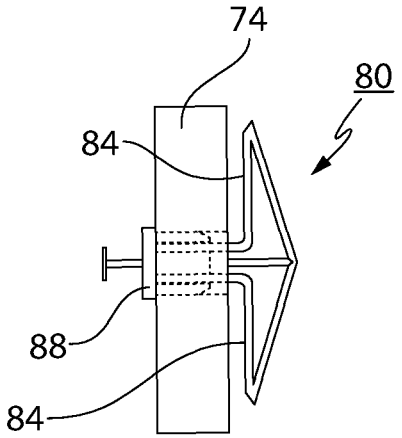

Referring to FIG. 5, a connector 54, which can be metal, plastic or any other suitable material, is permanently fastened to the lower surface 24 of the upper shelf. Any suitable means can be employed to permanently secure the connector 54 to the lower surface 24, e.g., by using screws, bolts, welding, etc. The particular means employed to attach the connector 54 to the lower surface 24 of the upper shelf 22 does not constitute a limitation on the broadest aspects of this invention.

Still referring to FIG. 5, the connector 54 includes a slotted end 56 through which a strap 52 is inserted to provide overlapping strap sections that are permanently attached together.

A buckle cam 58 or any other suitable fastening member is permanently attached to the strap 52.

In the preferred embodiment of this invention, buckle cams 58 are employed as the fastening members, and can be of an identical construction to the buckle cams employed on passenger seat belts used in aircraft. However, within the broadest aspects of this invention any suitable fastening member(s) can be employed.

Referring to FIGS. 1 and 2, the back wall 12 includes a pair of anchoring strap-receiving slots 60; each slot being in longitudinal alignment with a corresponding buckle cam 58. FIG. 2 shows the transverse spacing between the anchoring strap receiving slots 60, but, for purposes of clarity, the buckle cams 58 are omitted.

As can be seen best in FIG. 3, the buckle cam 58 prior to being connected to an anchoring strap 70 is vertically offset from the longitudinal axis of its longitudinally aligned strap-receiving slot 60.

Also, as is shown in FIGS. 2-4, the strap-receiving slots 60 are located in axial alignment with an interior surface of downwardly extending flange 28. This aids in visually concealing the anchoring system from view as will be discussed in greater detail hereinafter.

Referring to FIGS. 1, 3 and 4, the anchoring system of this invention includes anchoring straps 70, each including a proximal end 72 that is firmly attached to a supporting wall 74 or other supporting structure positioned closely adjacent back wall 12 of the storage unit 10. Each of the straps 70 includes a distal end 76 that is directed through a corresponding anchor strap-receiving slot 60 for connection to a corresponding buckle cam 58. FIG. 3 illustrates this condition of the anchoring system, prior to connecting the distal end 76 of the anchoring strap 70 to the buckle cam 58.

As can be seen in FIG. 4, the distal end of the anchoring strap is directed through the buckle cam in substantially the same manner as the distal end of a seat belt is secured about the lap of a passenger in an aircraft, and the distal end is then tightened to pull the buckle cam 58 into a location closely adjacent to lower surface 24 of the upper shelf 22. The free distal end 76 of each of the straps 70 is then directed through an aligned, anchoring strap receiving slot 60 so that it will not freely dangle in the interior compartment 18 of the storage unit 10.

As can be seen best in FIG. 4, when the anchoring system is maintained in a taut condition, it is in a location above the distal surface 30 of the inturned section 29 of the flange 28, and is thereby substantially concealed from view by an individual that accesses the interior compartment 18 of the locker 10 to either insert items into the interior compartment or remove items therefrom. In this regard, it should be understood that the upper shelf 22 preferably is positioned at approximately eye level or possibly a little higher or lower than eye level, but at an elevation that does not readily visually expose the anchoring system of this invention after it has been placed in a taut anchoring condition as is shown in FIG. 4.

As can be seen in FIGS. 3, 3A and 4, the proximal end 72 of each of the anchoring straps 70 (only one of which is shown) is folded over at 73 to provide a double thickness reinforced section for attachment to the supporting wall 74. The overlapping sections at the proximal end of each anchoring strap 70 include aligned passages therethrough, each preferably reinforced by a grommet or other reinforcing structure (only one of the aligned passages being shown at 76 in FIG. 3A). This double thickness section, with aligned passages therethrough is employed to secure each of the anchoring straps 70 to the supporting wall 74 in any desired manner.

The manner in which the anchoring straps 70 are connected to the supporting wall 74 or any other supporting structure does not constitute a limitation on the broadest aspects of the invention. In fact, many conventional fastening arrangements can be employed; the specific arrangement being employed depending upon whether the proximal end of the straps are aligned with studs or other solid surfaces to which an anchoring member can be attached after passing through the wall 74, or whether the anchoring straps are aligned with a hollow region behind a supporting wall, between supporting studs.

When the proximal end of an anchoring strip 70 is attached in a region of the wall overlying a stud, convention heavy duty screws or other threaded fastening means can be employed to firmly attach the proximal end 72 of each of the anchoring straps 70 to the wall structure.

When the proximal end 72 is aligned with a hollow region behind the wall 74, it is necessary to use a suitable anchoring device into which a screw or other fastener can be attached to secure the strap 70 to the supporting wall 74. A representative anchoring device 80 is shown in FIGS. 6A-6E. As can be seen best in FIG. 6A, the anchoring device 80 is a resilient, winged member having outwardly angled leg sections 82 overlying substantially transverse leg sections 84. The leg sections 82 meet at an apex 86. The anchoring device is made of a suitable plastic material having a memory for the configuration shown in FIG. 6A To use the winged anchoring member 80 an inward force is applied to the apex 86 to thereby force it inwardly to cause the legs 82, 84 to assume the configuration illustrated in FIG. 6B. In this position, a person can then squeeze the legs close together into a position generally shown in FIG. 6C, for insertion through an opening in the supporting wall 74. Once the compressed leg sections pass beyond the opening in the supporting wall 74 the spring material from which the anchoring member 80 is formed automatically will cause the legs 82, 84 to move outwardly into the general orientation shown in FIG. 6D. In that orientation, a pin or other pusher member can be inserted through a hollow hub 88 of the anchoring member 80 to engage the apex 86 and push it outwardly. This causes the wing member to assume the same general configuration as in FIG. 6A, with the transversely extending leg sections 84 overlying and closely adjacent to the inner surface of the support wall 74. This firmly attaches the anchoring member 80 to the wall 74, and a threaded screw of other threaded fastening device of conventional design (not shown) can be inserted through the aligned passages at the proximal end 72 of an anchoring strap 70 and then threaded into the passage through hub 88 of the anchoring member to firmly attach the anchoring strap to the supporting wall 74. In a preferred embodiment of the invention the screw actually imparts or forms threads in the inner peripheral wall defining the passage through the hub.

It should be understood that a variety of different anchoring members can be employed to attach a proximal end of an anchoring strap to a supporting wall in a region that is devoid of a stud or other structure behind the wall to receive and firmly hold a screw, bolt or other fastening member. The specific anchoring member that is employed does not constitute a limitation on the broadest aspects of this invention.

While the invention has been described in detail and with reference to specific embodiments thereof, it will be apparent to one skilled in the art that various changes and modifications can be made therein without departing from the spirit and scope thereof.

For example, although the preferred embodiment of this invention employs a pair of retaining members 50 for cooperating, respectively with a pair of anchoring straps 70, in accordance with the broadest aspects of this invention, it is possible to use more or less cooperating retaining members and anchoring straps. For example, in some embodiments, it may be possible to use only a single retaining member attached to a single anchoring strap to provide the desired anchoring function. In other embodiments it may be desirable to include more than 2 retaining members 50 cooperating with respective anchoring straps 70 to provide the desired anchoring function.

Also, although the preferred embodiment of this invention employs convention buckle cams to provide the attachment of the retaining members to corresponding anchoring straps, other fastening devices can be utilized in accordance with the broadest aspects of this invention. Moreover, although the most preferred embodiment of this invention employs an upper shelf with a downwardly directed flange to aid in attaching and concealing the retaining members of the anchoring system thereto, in accordance with the broadest aspects of this invention, an upper shelf can be omitted and retaining members can be suspended from the inner surface of the top wall of the storage unit to cooperate with anchoring straps directed through anchoring strap receiving slots also positioned close to the top wall of the locker. This arrangement will provide effective anchoring in accordance with the broadest aspect of this invention, although it may not provide concealment of the anchoring system from the view. However, even in accordance with this broader aspect of the invention, the anchoring system is provided completely in the interior of the storage unit and therefore does not include unsightly anchoring components located on any outside surface of the storage unit.

Moreover, although a preferred locker construction includes a lower drawer, an upper lock-box section and an upper open storage area, in accordance with the broadest aspect of this invention, these are optional features that can be omitted.

In accordance with the broadest aspect of this invention, the storage unit 10 can include a single interior compartment that is not subdivided into different storage areas by shelves, lock-boxes and/or drawers, as disclosed in the most disclosed embodiment of this invention.

What is claimed is:

1. A storage unit including an anchoring system for preventing the storage unit from tipping over; said storage unit including a back wall and transversely spaced apart side walls extending forwardly from said back wall and providing a front opening into an interior compartment for storing articles, said back wall and side walls providing peripheral walls of said interior compartment, a horizontal shelf located in an upper half of the interior compartment below a top wall of said storage unit and extending forward from a rear edge adjacent the back wall of the storage unit to a front edge adjacent said front opening of said interior compartment, at least one retaining member attached to a surface of said horizontal shelf at a location closer to the front opening than to the back wall of said storage unit and extending downwardly from said horizontal shelf, said back wall including at least one passage therethrough vertically below a lower surface of said top wall, said anchoring system including at least one anchoring strap member, said at least one anchoring strap member having a proximal end configured to be securely attached to a supporting wall or member adjacent the back wall of the storage unit and vertically below the top wall of said storage unit, each of said anchoring strap members extending through a respective passage and including a distal end configured for adjustable attachment to a respective retaining member in a location below a lower surface of said horizontal shelf, whereby each of said anchoring strap members is adjustably secured to a respective retaining member to maintain said anchoring strap members in a taut condition to stabilize the storage unit.

2. The storage unit and anchoring system of claim 1, said at least one passage through said back wall below a lower surface of said horizontal shelf includes at least two passages transversely spaced from each other, said at least one anchoring strap member including at least two anchoring strap members, each of said at least two anchoring strap members having a proximal end configured to be securely attached to said supporting wall or member adjacent the back wall of the storage unit and vertically below the top wall thereof, each of said at least two anchoring strap members extending through a corresponding passage in said back wall, said at least one retaining member attached to a lower surface of said horizontal shelf at a location closer to the front opening than to the back wall of said storage unit including a pair of retaining members, and each retaining member being in longitudinal alignment with a respective passage through said back wall, each of said at least two anchoring strap members having a distal end configured for adjustable attachment to a respective retaining member in longitudinal alignment with a passage through which a respective anchoring strap member extends, whereby said at least two anchoring strap members are adjustably secured to respective retaining members to maintain said at least two anchoring strap members in a taut condition to aid in stabilizing the storage unit.

3. The storage unit and anchoring system of claim 2, where said at least two passages are located in an upper half of said back wall.

4. The storage unit and anchoring system of claim 3, said front edge of said horizontal shelf includes a downwardly extending flange terminating at a distal edge, said at least two retaining members each including a buckle for receiving the distal end of a respective anchoring strap member and for permitting tightening of said at least two anchoring strap members within respective buckles and for retaining the at least two anchoring strap members in tightened condition, said buckles and said at least two anchoring strap members tightened therewith being in a substantially linear, taut condition in a location above the distal edge of the flange.

5. The storage unit and anchoring system of claim 4, wherein said at least two retaining members each includes a flexible strap having a proximal end attached to a lower surface of said horizontal shelf and a distal end attached to a respective buckle, each said respective buckles, prior to being retained in a substantially linear, taut condition, extending below the distal edge of the flange to provide easy accessibility to the respective buckles for permitting ease of attachment of the respective buckles to respective anchoring strap members.

6. The storage unit and anchoring system of claim 1, wherein said at least one passage is located in an upper half of the back wall.

7. The storage unit and anchoring system of claim 6, said front edge of said horizontal shelf includes a downwardly extending flange terminating at a distal edge, said at least one retaining member including a buckle for receiving the distal end of said at least one anchoring strap member and for permitting tightening of said at least one anchoring strap member within said buckle, said buckle tightening on said anchoring strap member to retain the at least one anchoring strap member in tightened condition, said buckle and respective anchoring strap member tightened therewith being in a substantially linear, taut condition in a location above the distal edge of the flange.

8. The storage unit and anchoring system of claim 7, wherein said at least one retaining member includes a flexible strap having a proximal end attached to a lower surface of said horizontal shelf and a distal end attached to said buckle, said buckle, prior to being retained in a substantially linear, taut condition extending below the distal edge of the flange to provide easy accessibility to the buckle for permitting ease of attachment of the buckle to a respective anchoring strap member.

9. The storage unit and anchoring system of claim 1, wherein said at least one passage through said back wall is vertically below a lower surface of said horizontal shelf.

10. The storage unit and anchoring system of claim 9, wherein the surface of said horizontal shelf to which said at least one retaining member is attached is a lower surface of said horizontal shelf.

11. The storage unit and anchoring system of claim 1, wherein the surface of said horizontal shelf to which said at least one retaining member is attached is a lower surface of said horizontal shelf.

* * * * *